United States Patent [19]

Andersson

[11] Patent Number: 4,646,487

[45] Date of Patent: Mar. 3, 1987

[54] PLASTIC GUTTER

[75] Inventor: Peter B. Andersson, Vaerloese, Denmark

[73] Assignee: Rivus A/S, Naestved, Denmark

[21] Appl. No.: 777,084

[22] PCT Filed: Jan. 23, 1985

[86] PCT No.: PCT/DK85/00003

§ 371 Date: Sep. 5, 1985

§ 102(e) Date: Sep. 5, 1985

[87] PCT Pub. No.: WO85/03541

PCT Pub. Date: Aug. 15, 1985

[30] Foreign Application Priority Data

Jan. 31, 1984 [DK] Denmark ..... 419/84

[51] Int. Cl.[4] ..... E04D 13/00

[52] U.S. Cl. ..... 52/11; 403/311; 403/344

[58] Field of Search ..... 52/11, 16; 403/311, 403/344

[56] References Cited

U.S. PATENT DOCUMENTS

| | | | |
|---|---|---|---|
| 2,753,962 | 7/1956 | McBerty | 403/344 UX |
| 4,190,988 | 3/1980 | Carreiro | 52/11 X |

FOREIGN PATENT DOCUMENTS

| | | |
|---|---|---|
| 133707 | 7/1976 | Denmark . |
| 1272514 | 9/1961 | Fed. Rep. of Germany . |
| 5356720 | 5/1978 | Japan . |
| 74132143 | 4/1975 | Sweden . |
| 77041150 | 11/1977 | Sweden . |
| 1026542 | 4/1966 | United Kingdom . |

*Primary Examiner*—Carl D. Friedman

*Attorney, Agent, or Firm*—Merchant, Gould, Smith, Edell, Welter & Schmidt

[57] ABSTRACT

A plastic gutter is designed with a longitudinally extending bead (5) under an outwardly facing lip (4) and a corresponding longitudinally extending bead (5) on the inside of the rear part. At least at the end of each length of gutter the longitudinally extending beads have been machined in such a manner that material has been removed at regular intervals so that the remaining material constitutes one or more locking pieces (6).

An assembly piece (7) with a rubber packing (8) for assembling adjoining lengths of gutter, for example, has a number of locking holes (9) in an outwardly facing lip (11) and a number of corresponding locking holes (9) in a bent edge part (10) at the rear.

There is hereby obtained a gutter which is both quickly and easily mounted and taken down and where the parts are nevertheless securely held together so that an axial movement between the parts will not occur.

5 Claims, 6 Drawing Figures

PLASTIC GUTTER

Figure 1:
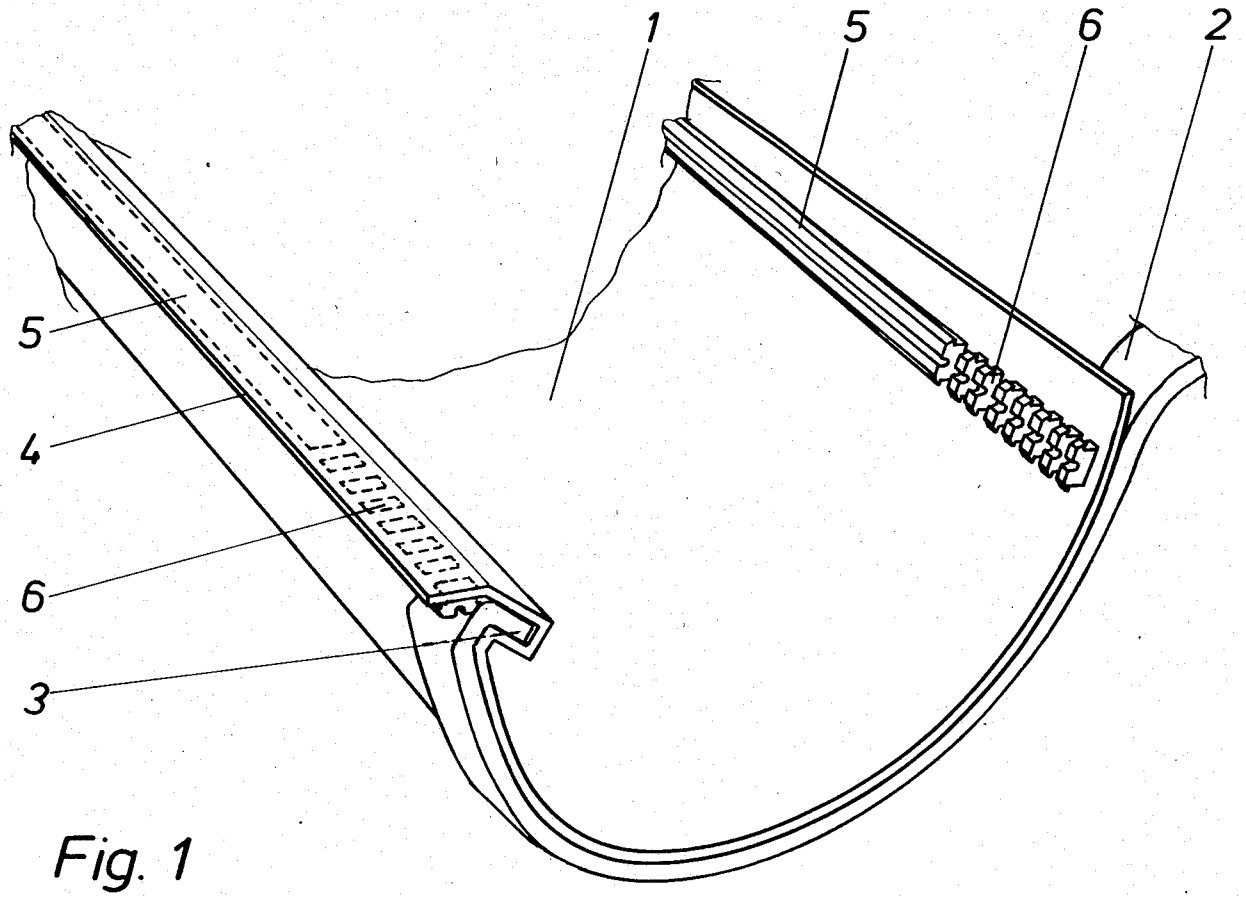

The invention relates to a plastic gutter.

It is known to assemble plastic gutters by glueing in that an assembly piece is for example placed with its inside in close engagement with the outside of the end zones of the lengths of gutter and in that a layer of glue is applied between these surfaces. The glue partly serves to provide complete tightness and partly to connect the two lengths of gutter so that they cannot move in relation to each other or in relation to the assembly piece. End caps, spout joints, connectors, corner joints and similar assembly pieces are fastened in the same manner.

It is widely felt to be a drawback that the parts have to be glued together and it also requires a certain degree of care to make a correct assembly by glueing. Leaking glue may give an undesired discoloration, and in damp weather it may be very difficult to carry out the assembly work by glueing. The used types of glue moreover contain poisonous solvents and are unpleasant to work with.

There is therefore a great demand for plastic gutters which can be assembled without any use of glue, and various structures have also been suggested, such structures having packing rings of rubber or similar material that are placed in grooves or similar recesses in the assembly pieces and the lengths of gutter. Such packing means, however, will not provide sufficient hold against axial displacement so that such displacement will either have to be tolerated or neutralised by means of special assembly means or fastening means.

Danish patent specification No. 133,707 describes a plastic gutter where the individual parts are assembled and held together by detachable pushbutton pins made of a flexible plastic material and where the waterproofing is obtained by applying a suitable jointing filler between the cooperating surfaces. This structure, however, is also encumbered with drawbacks in that the lengths of gutter will have to be provided with holes for the pins at the place of assembly and in that it must be ensured that the jointing filler fully encircles the pin holes so that the gutter is waterproof. This structure also has the drawback that just like glued gutters it is difficult to repair and take down because the jointing filler will bind the parts so strongly that they are often damaged when an attempt is made to take apart the gutter at their places of assembly.

The object of the invention is to provide a new structure of a gutter with assemply parts which requires neither glue nor jointing filler but where it is possible to use an ordinary rubber packing and still be quite sure that no axial displacement will occur between the parts and where a gutter structure is obtained which is quickly and easily mounted and taken down.

Such a structure can always be disassembled in that there are no permanent assemblies, the assembly being still so strong that the parts will not displace axially in relation to each other. As a packing it is possible to use a rubber packing but various jointing fillers can of course also be used if so desired. The assembly will always by quite tight because there are no holes neither in the lengths of gutter nor in the assembly parts. Such a gutter may be assembled and mounted in all kinds of weather and without any problems since the individual parts are simply snapped together so that the locking pieces engage the locking holes.

According to another aspect of the invention, lengths of gutter that can still be manufactured by extrusion as the known gutters but where the locking pieces are formed by a simple finishing. If only part of the longitudinally extending bead or beads are machined to form locking pieces, the unmachined part of the bead or beads will act as a reinforcement of the length of gutter so that it is possible to form same with a smaller wall thickness than normally or it is possible to obtain a gutter which is much more solid than the known gutters.

In another aspect of the invention the locking pieces will be placed at the most advantageous places of the gutter and a strong reinforcement is moreover obtained. The longitudinally extending bead under the outwardly facing lip will for instance prevent the gutter from being damaged when a solid ladder is placed against the gutter, for example when some person is to inspect or clean the gutter.

In another aspect of the invention, the gutter will in a simple manner be secured in supporting means that can be ordinary gutter brackets provided with a bent part. This will facilitate the mounting and the taking down of the gutter and the gutter will nevertheless be securely retained in the gutter brackets.

In another aspect of the invention, the longitudinally extending rows of locking holes are arranged quite outside the part of the gutter which is to carry the rain water so that sealing problems will never occur on account of these holes.

In another aspect of the invention, the locking pieces may be slightly flexible so that they can be designed to form a tight fit with the locking holes whereby the assembly becomes particularly strong.

In another aspect of the invention, dependent on how strong an assembly is desired or dependent on which material the plastic gutter is manufactured of.

Figure 2:
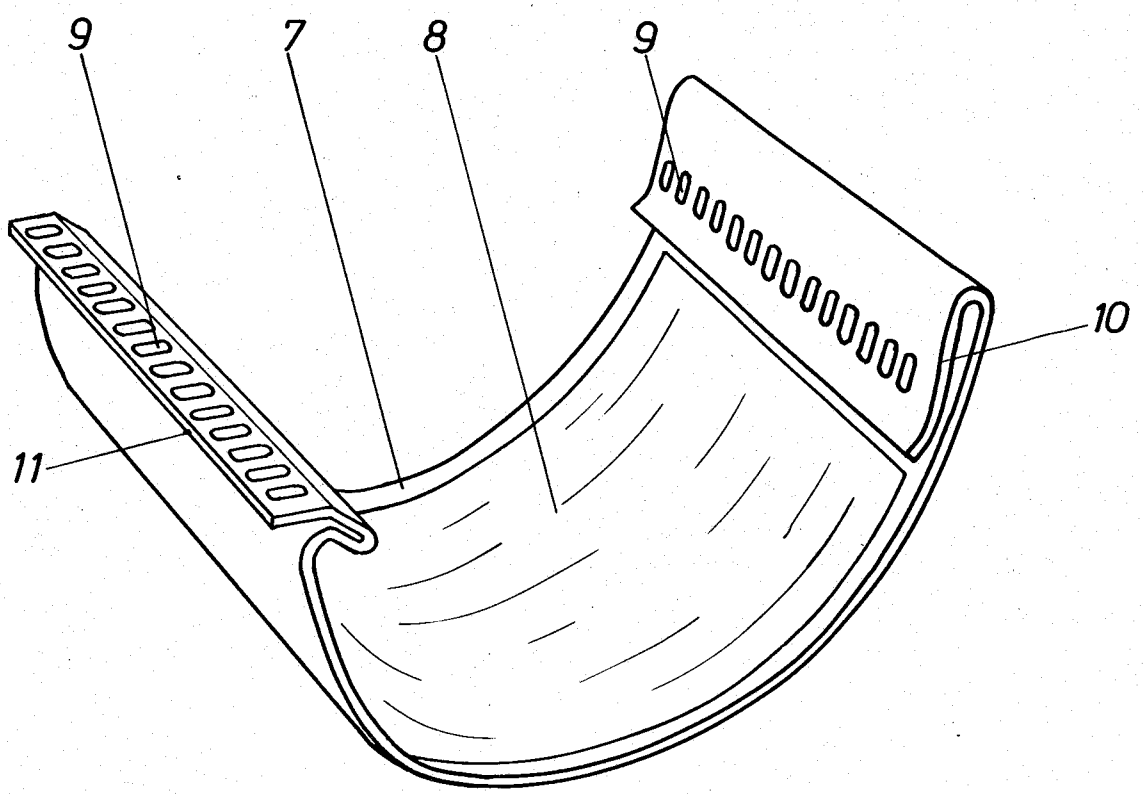
Figure 3:
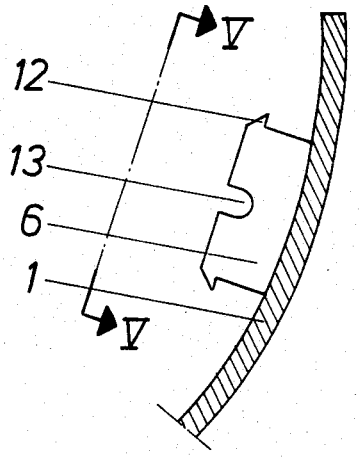
Figure 4:
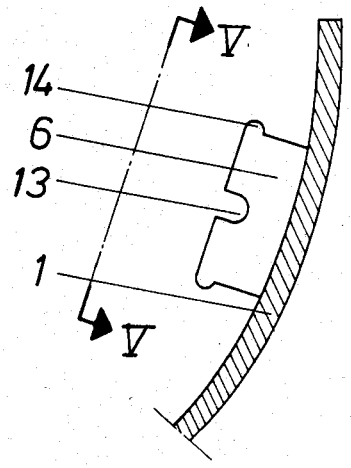
Figure 5:
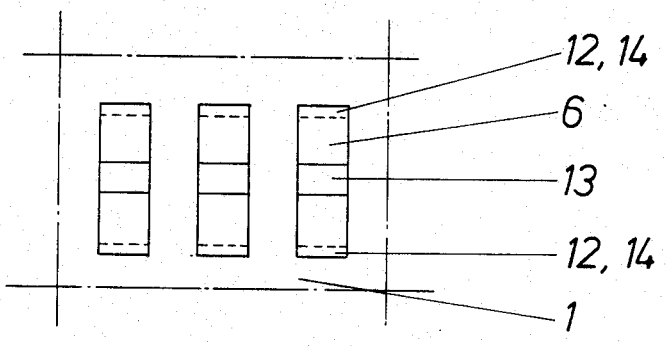

The invention will be further explained in the following with reference to the drawing showing a preferred embodiment of the invention, wherein FIG. 1 is a perspective upper view of a length of gutter according to the invention, FIG. 2 is an assembly piece therefor, FIG. 3 is a sectional view of a locking means, FIG. 4 is a plane view of another embodiment of a locking means, and FIG. 5 is locking means according to FIGS. 3 or 4 but seen from in front in the direction V—V.

Figure 6:
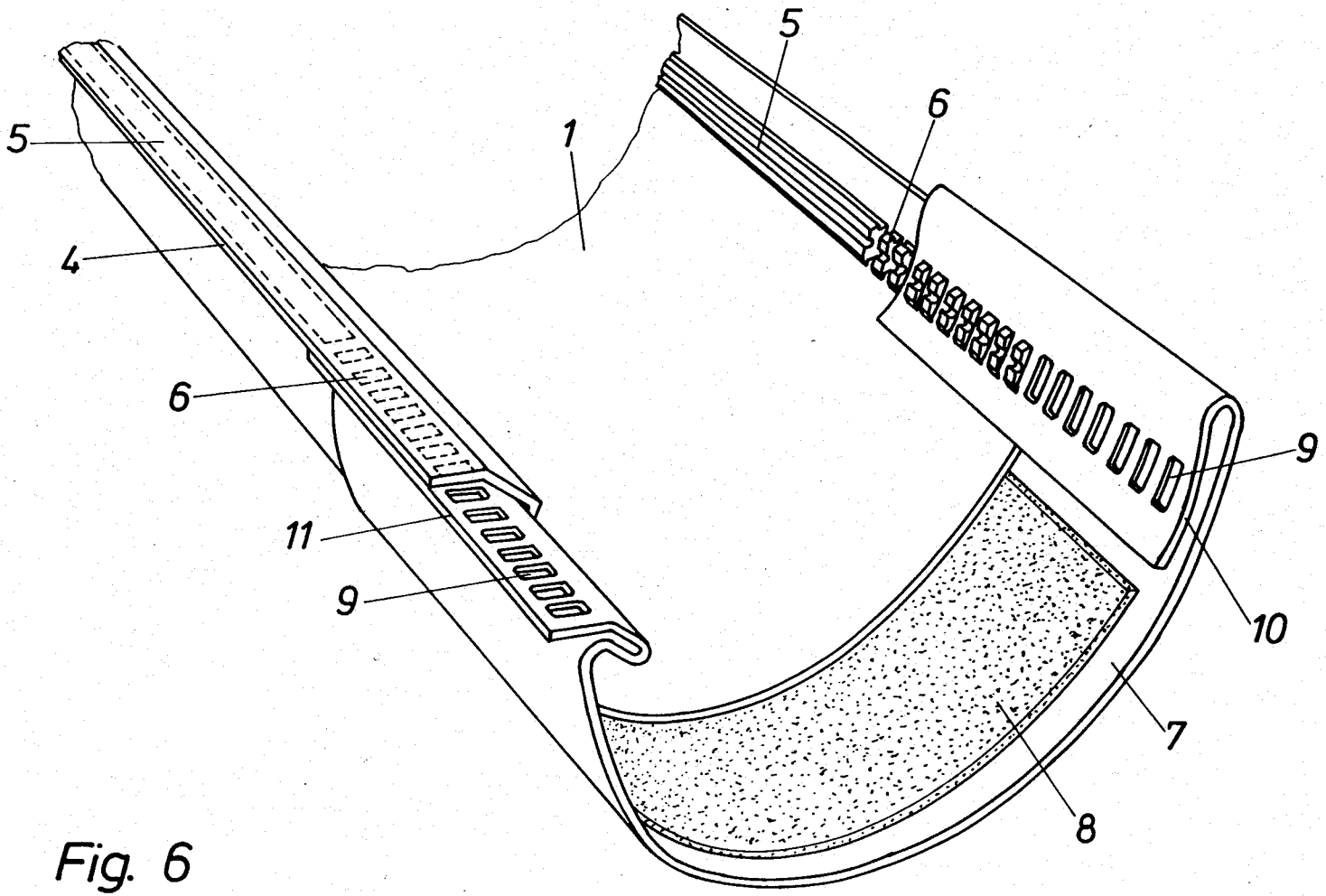

FIG. 6 is a view like FIGS. 1 and 2 with elements shown therein joined.

In FIG. 1 the reference numeral 1 is an ordinary curved gutter but might just as well be a gutter of any other shape. The gutter is shown with an inserted gutter bracket 2 and for the sake of clarity the gutter bracket 2 is shown by the end of the length of gutter so that it clearly appears how an inwardly bent edge part 3 on the gutter bracket 2 can snap into a bent and outwardly extending lip 4 forming the front of the gutter.

On the inside of the rear of the gutter there is a longitudinally extending bead 5 which by the end of the gutter has been machined for example by cutting, sawing or grinding so that at regular intervals material has been removed from the bead to the effect that the remaining material appears as outwardly extending pins forming locking pieces 6.

In the same manner there is a longitudinally extending bead 5 under the outwardly facing lip 10, said bead being designed as locking pieces 6 by a corresponding machining.

The longitudinally extending beads 5 are formed integrally with the gutter itself the entire gutter having been moulded in plastic, for example polyvinyl chloride, by extrusion or in a similar manner.

In FIG. 2 there is shown an assembly piece 7 with an inlaid or inserted rubber packing 8. The assembly piece is intended to mutually connect adjoining lengths of gutter or other assembly parts with lengths of gutter, the outwardly facing lip 11 being provided with a longitudinally extending row of locking holes 9 corresponding to the locking pieces 6 in the outwardly facing lip in the gutter, and the rear of the assembly piece having a bent edge part 10 where the bent part is provided with a longitudinally extending row of locking holes which are adapted to engage the locking pieces 6 on the inside of the rear of the gutter in FIG. 1.

FIGS. 3–5 show examples of embodiments of the locking piece 6 which can for example be provided with a central groove 13 that can be pre-shaped in the longitudinally extending bead. The central groove 13 makes the locking pieces flexible so that it is easier to make the locking pieces engage the locking holes if the locking pieces are designed with a locking edge, for example a sharp locking edge with a plane surface 12 or a rounded locking surface with a rounded shoulder part 14.

It is obvious to a person skilled in the art that it is possible to interchange locking pieces and locking holes in relation to what is shown in the drawing so that the locking holes are arranged in the length of gutter and the locking pins in the assembly piece. It is most practical, however, if the design is as shown in the drawing.

The other types of assembly parts such as adaptors, spout joints, end caps, connectors, corner joints and similar parts which are also used when mounting gutters are designed in a similar way with locking See FIG. 6 for an example. means and are secured either directly or by means of an assembly piece as shown in FIG. 2.

The invention has been explained with reference to the particular embodiment shown in the Figures of the drawing. It is obvious to a person skilled in the art, however, that numerous other detailed embodiments are imaginable when using the explained technique.

The bead 5 which is machined to form locking pieces 6 may be arranged at various places inside the gutter and there may be one or more beads and they can have the same or different profiles, for example a profile as shown in FIGS. 3–5, a quite rectangular or square profile, or any other suitable profile. The number of beads and the placing thereof are arranged according to requirements.

The bead 5 on the outwardly facing lip 4 is designed in such a manner that the inwardly bent edge part 3 of the gutter bracket secures the gutter so that this is not pressed out by gusts of wind, snow and ice or the pressure from a ladder or similar implements that are placed against the gutter.

I claim:

1. Plastic gutter for use with assembly parts therefor, such as assembly pieces, adaptors, spout joints, end caps, connectors, corner joints and like parts, said gutter being adapted to be retained in supporting means which are secured to wall or roof, and where the gutter and the assembly parts therefor are provided with cooperating and mutually engaging locking means, characterised in that the locking means includes at least one longitudinally extending row of identical pins placed at regular intervals, said pins being arranged on one of the parts and protruding perpendicularly to the longitudinal direction and are adapted to engage a row of holes, said holes being placed at similar intervals in the other part to prevent lateral movement of the gutter and parts when so joined, and wherein the gutter and the assembly part therefor have an outwardly bent lip, characterised in that both under the outwardly bent lip and on the inside situated opposite the bent lip the gutter has a longitudinal row of pins.

2. Plastic gutter according to claim 1, characterised in that the assembly parts have longitudinally extending rows of holes corresponding to the placing of the pins of the lengths of gutter, said holes being provided in an outwardly facing lip as well as in a bent edge portion at the rear of the assembly part.

3. Plastic gutter for use with assembly parts therefor, such as assembly pieces, adaptors, spout joints, end caps, connectors, corner joints and like parts, said gutter being adapted to be retained in supporting means which are secured to wall or roof, and where the gutter and the assembly parts therefor are provided with cooperating and mutually engaging locking means, charaterised in that the locking means includes at least one longitudinally extending row of identical pins placed at regular intervals, said pins being arranged on one of the parts and protruding perpendicularly to the longitudinal direction and are adapted to engage a row of holes, said holes being placed at similar intervals in the other part said row of pins having a central recess and at least one locking edge at their outer peripheral edge.

4. Plastic gutter according to claim 3, characterised in that the locking edge has at least one plane surface which can firmly engage a hole by snap action.

5. Plastic gutter according to claim 3, characterised in that the locking edge has at least one rounded shoulder part.

* * * * *

UNITED STATES PATENT AND TRADEMARK OFFICE

CERTIFICATE OF CORRECTION

PATENT NO. : 4,646,487

DATED : 3 March 1987

INVENTOR(S) : Peter B. Andersson

It is certified that error appears in the above-identified patent and that said Letters Patent is hereby corrected as shown below:

In Column 1, line 51, "assemply" should be --assembly--.

In Column 1, line 57, delete "Such" and insert therefor --According to one aspect of the invention,--.

In Column 1, line 63, "neither" should be --either--.

In Column 3, lines 38 and 39, delete "See Fig. 6 for an example".

In Column 4, line 40, after "FIG. 2." insert --See FIG. 6 for an example--.

Signed and Sealed this

Fifteenth Day of March, 1988

*Attest:*

DONALD J. QUIGG

*Attesting Officer*

*Commissioner of Patents and Trademarks*